US005619940A

United States Patent [19]

Moriguchi

[11] Patent Number: 5,619,940

[45] Date of Patent: Apr. 15, 1997

[54] AUTOMATIC SANDWICH LINKING METHOD AND MACHINE

[75] Inventor: Saichiro Moriguchi, Kanazawa, Japan

[73] Assignee: Tsudakoma Kogyo Kabushiki Kaisha, Ishikawa-ken, Japan

[21] Appl. No.: 568,228

[22] Filed: Dec. 6, 1995

[30] Foreign Application Priority Data

Dec. 29, 1994 [JP] Japan ..... 6-338629

[51] Int. Cl.[6] ..... D05B 7/00; D04B 15/02

[52] U.S. Cl. ..... 112/27; 66/148

[58] Field of Search ..... 112/25–27, 470.03, 112/470.07, 470.13, 470.17, 475.05, 475.03; 66/147, 148

[56] References Cited

U.S. PATENT DOCUMENTS 4,846,085 7/1989 Isibashi et al. ..... 112/27

FOREIGN PATENT DOCUMENTS 2133363 1/1973 Germany .
3-49478 7/1991 Japan .

*Primary Examiner*—Ismael Izaguirre
*Attorney, Agent, or Firm*—Wenderoth, Lind & Ponack

[57] ABSTRACT

An automatic sandwich linking machine is provided with first, second and third point needles, guides a first and a second edge portion of a first knitted fabric, such as an accessory part of a garment, to a first and a second needling position, respectively, hooks the first and second edge portions of the first knitted fabric over the first and the second point needles at the first and the second needling position, respectively, guides an edge portion of a second knitted fabric, such as a body part of the garment, to a third needling position, hooks the edge portion of the second knitted fabric over the third point needles, transfers the edge portion of the second knitted fabric from the third point needles to the first point needles, transfers the first edge portion of the first knitted fabric and the edge portion of the second knitted fabric from the first point needles to the second point needles or transfers the second edge portion of the first knitted fabric from the second point needles to the first point needles to sandwich the edge portion of the second knitted fabric between the first and the second edge portion of the first knitted fabric, and links the thus superposed edge portions of the first and the second knitted fabrics by a sewing machine.

6 Claims, 10 Drawing Sheets

AUTOMATIC SANDWICH LINKING METHOD AND MACHINE

BACKGROUND OF THE INVENTION

1. Field of the Invention

The present invention relates to an automatic sandwich linking method and an automatic sandwich linking machine.

2. Description of the Related Art

When linking up two knitted fabrics by an automatic single linking machine disclosed in JP-B No. 3-49478, the two knitted fabrics are hooked over two sets of point needles, respectively, the positions of stitches on linking lines of the two knitted fabrics are adjusted for correct positioning at a needling position by image processing techniques so that every point needle is thrusted in a stitch, the knitted fabrics are moved together with the point needles, the knitted fabric on the point needles of one of the two sets of point needles is transferred to the point needles of the other set of point needles, and the two knitted fabrics are linked up. This known automatic single linking machine is intended specially for single linking and is incapable of sandwich linking. Therefore, it has been a usual practice to hook three edges, i.e., one edge of a knitted fabric and the two edges of another knitted fabric, over point needles arranged in a row by hand to sandwich the edge of the former knitted fabric between the two edges of the latter knitted fabric, and the two knitted fabrics are linked together by a sewing machine. This sandwich linking operation is inefficient and the automation of a sandwich linking operation has been desired.

SUMMARY OF THE INVENTION

Accordingly, it is an object of the present invention to provide an automatic sandwich linking method and an automatic sandwich linking machine capable of automatically carrying out the sandwich linking method to save work for sandwich linking.

With the foregoing object in view, the present invention uses three sets of point needles and carries out an automatic sandwich linking method comprising steps of guiding the two edge portions of a first knitted fabric, such as an accessory part of a garment, to two needling positions, respectively, and hooking the same edge portions of the first knitted fabric over the point needles of the first needle set (hereinafter referred to as "the first point needles") and the point needles of the second needle set (hereinafter referred to as "the second point needles"), respectively; guiding one edge portion of a second knitted fabric, such as a body part of the garment, to a needling position and hooking the same edge portion over the point needles of the third needle set (hereinafter referred to as "the third point needles"); transferring the second knitted fabric from the third point needles to the first point needles; transferring the knitted fabrics from the first point needles to the second point needles or the knitted fabric from the second point needles to the first point needles; and linking up the first and the second fabric hooked over the first point needles or the second point needles.

The present invention further provides an automatic sandwich linking machine comprising: point needles of three needle sets; a first fabric guiding means for guiding two edge portions of a first knitted fabric to two needling positions, respectively; a first needle moving means for hooking one of the edge portions of the first knitted fabric over the first point needles at the first needling position and moving the same edge portion of the first knitted fabric together with the first point needles; a second needle moving means for hooking the other edge portion of the first knitted fabric over the second point needles at the second needling position and moving the same edge portion of the first knitted fabric together with the second point needles; a second fabric guiding means for guiding one edge portion of a second fabric to a third needling position; a third needle moving means for hooking the edge portion of the second fabric over the third point needles at the third needling position, and moving the second fabric together with the third point needles; a first transfer means for transferring the second fabric held on the third point needles to the first point needles; a second transfer means for transferring the edge portion of the first knitted fabric, the edge portion of the second knitted fabric held on the first point needles to the second point needles or transferring the edge portion of the first knitted fabric held on the second point needles to the first point needles; and a sewing machine for linking together the first and the second fabric held on the second point needles or the first point needles with the edge portion of the second knitted fabric sandwiched between the edges of the first knitted fabric.

Each of the first and the second fabric guiding means may be such a means having a function to find and guide stitches to be linked to the needling position, i.e., a stitch finding function, comprising, for example, a camera, an image processing unit and a fabric position adjusting device, or comprising, in addition to those components, a fabric feed means for regulating the edge portion of the knitted fabric and feeding the knitted fabric to a needling position, or may be such a means not having any stitch finding function and having an edge guiding function, comprising, for example, an edge sensor and a fabric position adjusting means, or comprising an edge regulating means having an edge regulating surface, and a fabric feed means. It is desirable, in view of finishing in a satisfactory appearance, to apply a fabric guiding means having a stitch finding function to the first or the second needling position where stitches on the right side of a finished garment are hooked over the point needles.

The needle moving means moves the knitted fabric to a needling position and hooks the knitted fabric over the point needles by advancing the point needles toward the knitted fabric or moving the knitted fabric toward the point needles. The point needles of the first and the second needle moving means are arranged linearly and those of the third needle moving means are arranged in a circle or the point needles of the first, the second and the third needle moving means are arranged linearly or in a circle.

The transfer means for transferring a knitted fabric from the point needles of one needle set to those of another needle set, may comprise a single plate having an inclined surface parallel to a plane when each of the point needles of one needle set and each of the point needles of another needle set extend opposite to each other in a line in the plane or having two inclined surfaces parallel to two planes inclined at an angle to each other, respectively, when each of the point needles of the former needle set and each of the point needles of the latter needle set extend at an angle to each other in those two planes, respectively, may comprises a single air jet nozzle that jets compressed air to move a knitted fabric when each of the point needles of one needle set and each of the point needles of another needle set extend opposite to each other in a line in the plane or two air jet nozzles that jet compressed air in parallel to two planes inclined at an angle to each other, respectively, when each of the point needles of the former needle set and each of the point needles of the latter needle set extend at an angle to each other in those two planes, respectively, or may comprise a single brush capable of being advanced and retracted along a fabric transferring direction when each of the point needles of one needle set and each of the point needles of another needle set extend opposite to each other in a line in the plane or two brushes capable of being advanced and retracted along fabric guiding directions parallel to two planes inclined at an angle to each other, respectively, when each of the point needles of the former needle set and each of the point needles of the latter needle set extend at an angle to each other in those two planes, respectively.

Thus the present invention employs three needle sets of point needles, hooks the first and the second knitted fabric over the point needles of these three needle sets, and transfers the knitted fabrics between the point needles of the needle sets to combine the knitted fabrics in a sandwich layer for automatic sandwich linking.

BRIEF DESCRIPTION OF THE DRAWINGS

The above and other objects, features and advantages of the present invention will become more apparent from the following description taken in connection with the accompanying drawings, in which.

DETAILED DESCRIPTION OF THE PREFERRED EMBODIMENTS

First Embodiment

An automatic sandwich linking machine in a first embodiment according to the present invention shown in FIGS. 1 to 10 hooks the edge portions of a first knitted fabric, such as an accessory part of a garment, over a plurality of first point needles and a plurality of second point needles, respectively, hooks a second knitted fabric, such as a body part of the garment, over a plurality of third point needles arranged in a circle, guides the first and the second knitted fabric by a first and a second fabric guiding device having a stitch finding function and an edge guiding function, combines the first and the second knitted fabric by transfer plates serving as a first and a second transfer device so that the edge portion of the second knitted fabric is sandwiched between the edge portions of the first knitted fabric, and links up the stitches in the overlapping portions of the first and the second knitted fabric by a sewing machine.

Figure 1:
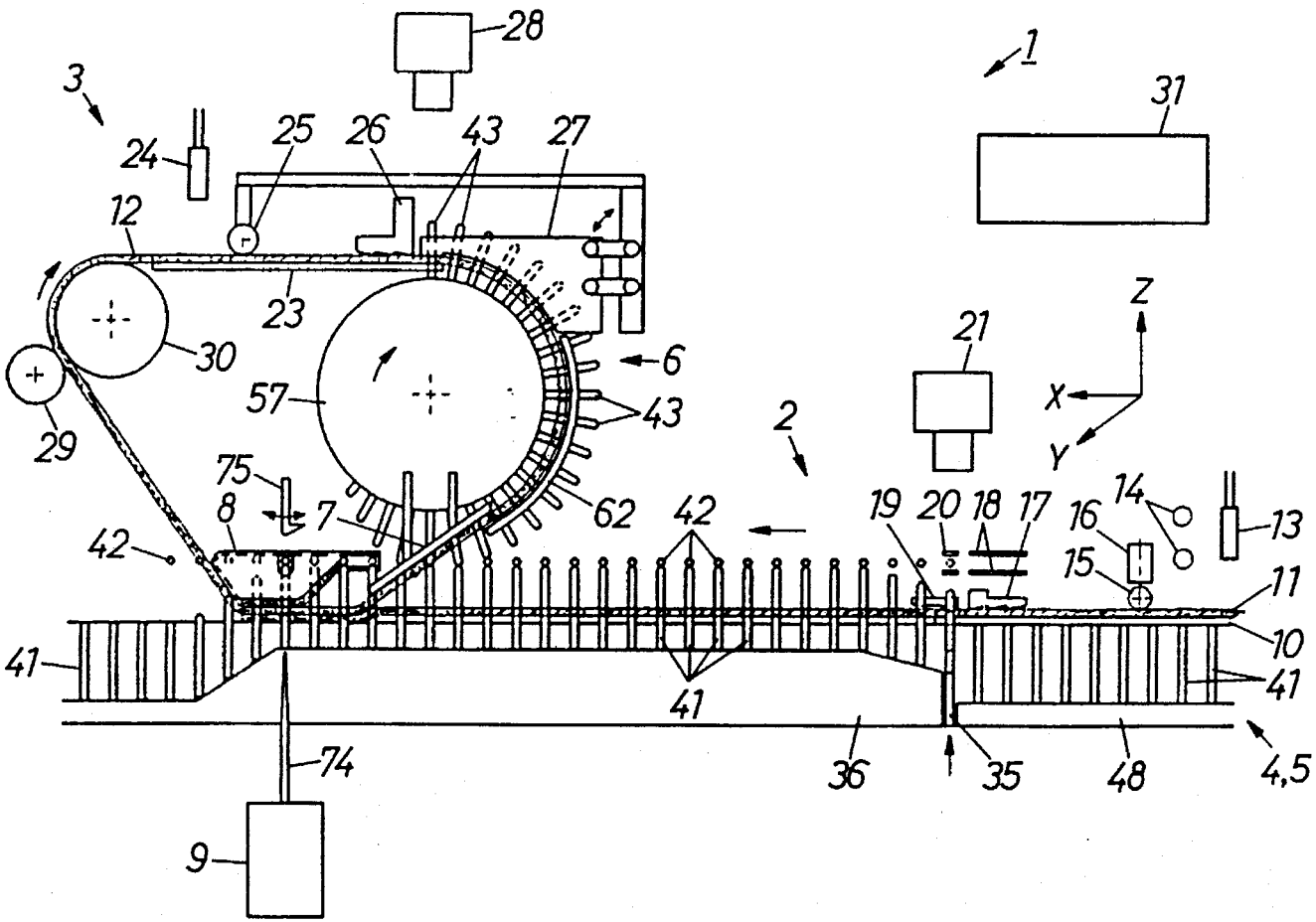
FIG. 1 is a schematic side view of an automatic sandwich linking machine in a first embodiment according to the present invention.
Figure 2:
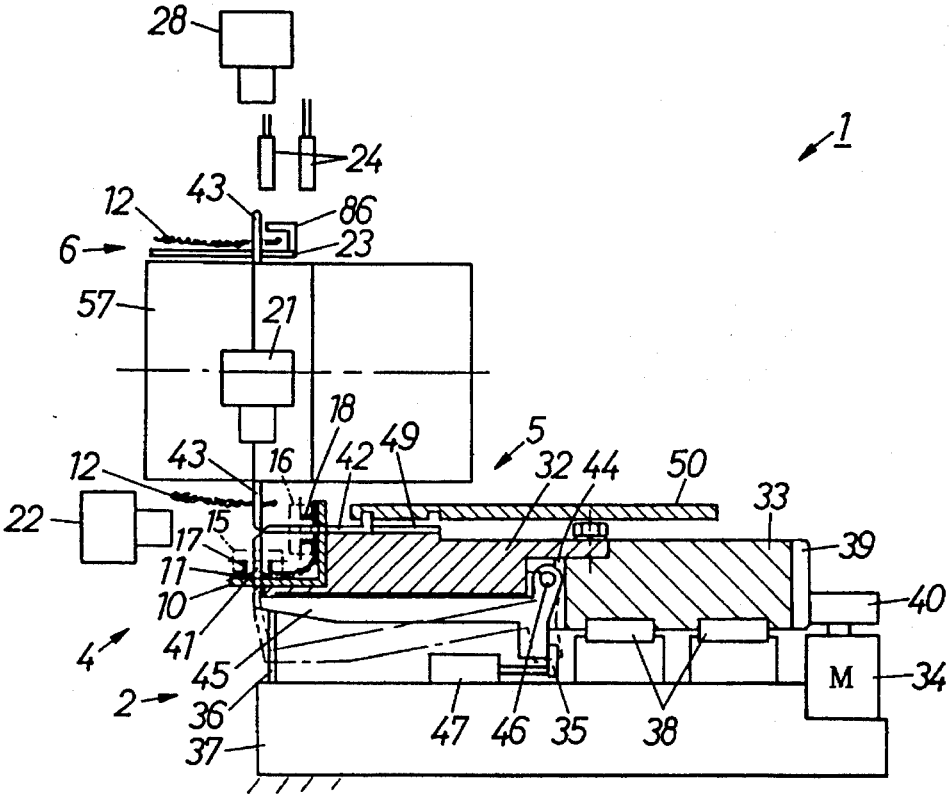
FIG. 2 is a fragmentary sectional view of the automatic sandwich linking machine of FIG. 1.

Referring to FIGS. 1 and 2, an automatic sandwich linking machine 1 comprises a first fabric guide device 2, a second fabric guide device 3, a first needle moving device 4, a second needle moving device 5, a third needle moving device 6, a first transfer device 7, a second transfer device 8 and a sewing machine 9.

The first fabric guide device 2, which guides the two edge portions of a first knitted fabric 11 along the guide surfaces of an L-shaped table 10 having an L-shaped cross section to a first and a second needling position, respectively, comprises a pair of edge sensors 13 and 14, rollers 15 and 16, a pair of primary hands 17 and a pair of primary hands 18, a pair of secondary hands 19 and a pair of secondary hands 20, and cameras 21 and 22. The second fabric guide device 3, which guides the edge portion of a second knitted fabric 12 to a third needling position, comprises a fixed table 23, a pair of edge sensors 24 disposed opposite to the surface of the fixed table 23, a roller 25, a pair of primary hands 26, a pair of secondary hands 27, a camera 28, a presser roller 29, and a guide roller 30 for feeding a knitted fabric. Guide plates 86 having an L-shaped cross section are disposed in combination with the L-shaped table 10 and the fixed table 23, respectively, to flatten the curled edge portions of the knitted fabrics in order that the pairs of edge sensors 13, 14 and 24 are able to detect the positions of the edges of the knitted fabrics correctly. The guide plate 86 extended on the opposite sides of the edge sensors 24 with respect to a direction in which the second knitted fabric 12 is fed so as to hold the edge portion of the second knitted fabric 12 on the fixed table 23.

The cameras 21, 22 and 28, such as CCD cameras, are connected to an image processing unit 31 for processing images formed by the cameras 21, 22 and 28 to obtain data for controlling a stitch finding operation and a fabric guiding operation. The image processing unit 31 drives the rollers 15, 16 and 25 for axial movement, and moves the pairs of primary hands 17, 18 and 26 and the secondary hands 19, 20 and 27 for positional adjustment according to signals received from the edge sensors 13, 14 and 24, and image data received from the cameras 21, 22 and 28 to guide the edges of the knitted fabrics and to find the stitches of the knitted fabrics.

The first needle moving device 4, which hooks the first edge portion of the first knitted fabric 11 on the first point needles 41 at a first needling position and guides the first edge portion of the first knitted fabric to a linking position, comprises a slider 33, a motor 34, a needle raising member 35 and a plate cam 36. The slider 33 is supported with bearings 38 on a fixed base 37 for sliding movement in a guiding direction. A pinion 40 mounted on the output shaft of the motor 34 mounted on the base 37 is engaged with a rack 39 formed in the side surface of the slider 33 to drive the slider 33 on the fixed base 37 in the guiding direction by the motor. The L-shaped table 10 is fixed to the fixed base 37 by stays, not shown.

A thrusting member 32 combined with the slider 33 is provided with a plurality of parallel grooves 44 arranged at predetermined pitches along the row of the first point needles 41, and a lever 45 is supported pivotally by a pin 46 in each groove 44. Each of the first point needles 41 is attached to the extremity of an arm of the lever 45 so as to be projected vertically upward from the upper surface of the horizontal wall of the L-shaped table 10 through a slit formed in the horizontal wall of the L-shaped table 10. The needle raising member 35 disposed between the plate cam 36 and an auxiliary cam 48 at the first needling position is connected to the plunger of a solenoid 47 so as to be in contact with the heel of the lever 45 to raise the first point needles 41 from the upper surface of the auxiliary cam 48 to the upper surface of the plate cam 36.

Figure 3:
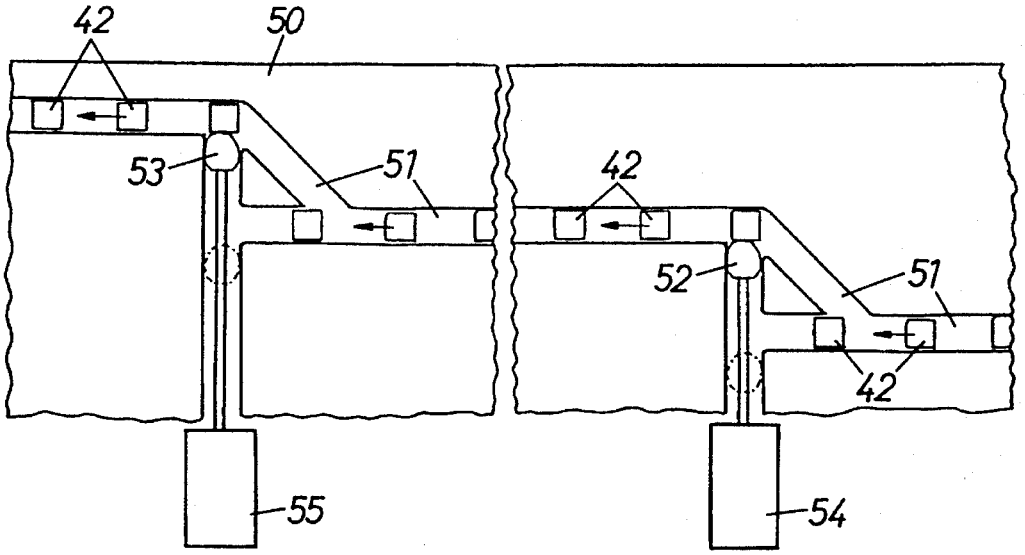
FIG. 3 is a plan view which assists in explaining the relation between second point needles and a groove cam.
Figure 4:
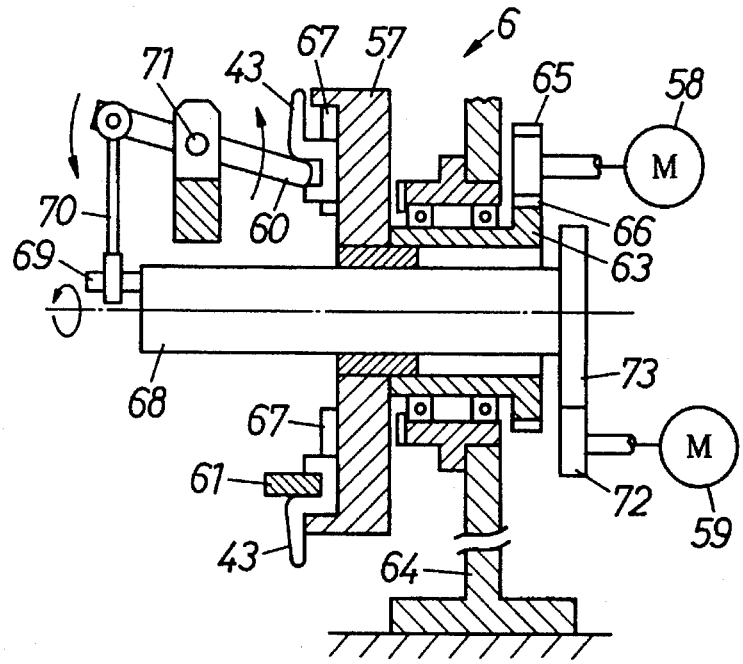
FIG. 4 is a sectional view of a point needle driving mechanism for driving third point needles.
Figure 5:
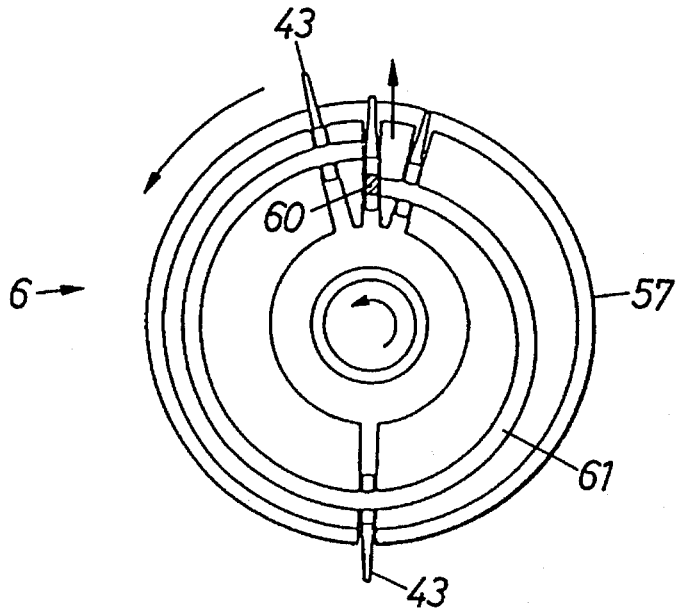
FIG. 5 is a front view of a cam for moving the third point needles.

The thrusting member 32 is provided in its upper surface with a plurality of parallel guide grooves 49 at predetermined pitches equal to those of the first point needles 41 to receive the second point needles 42 slidably therein, respectively. The second point needles 42 can be projected through slits formed in the vertical wall of the L-shaped table 10 so as to extend across a direction in which the first point needles 41 are raised. As shown in FIG. 3, each of the second point needles 42 has a butt fitted in a cam groove 51 formed in a fixed groove cam 50. When the slider 33 is reciprocated, the groove cam 50 advances and retracts the second point needles 42 by the cam groove 51. The groove cam 50 is held fixedly on the base 37 by stays, not shown. The cam groove 51 has a retracting section for retracting the second point needles 42, a needling section for advancing the second point needles 42 to a thrusting position and a transfer section for advancing the second point needles 42 to a transfer position. The second point needles 42 are pushed from the retracting section into the needling section by a pushing member 52 operated by a solenoid 54 and are pushed from the needling section into the transfer section by a pushing member 53 operated by a solenoid 55. When retracting the second point needles 42, the second point needles 42 move from the transfer section to the needling section along an oblique section and from the needling section to the retracting section along an oblique section.

Referring to FIGS. 1, 2, 4 and 5, the third needle moving device 6, which thrusts the third point needles 43 into the second knitted fabric 12 at the third needling position and moves the second knitted fabric 12 toward the linking position, comprises the fixed table 23, the pair of secondary hands 27, a guide member 62 having the shape of a circular arc, the first transfer member 7, a rotary drum 57, motors 58 and 59, a needle raising member 60 and a fixed guide 61. The rotary drum 57 is mounted on a hollow shaft 63 supported for rotation on a fixed frame 64 so as to be driven for rotation at a set rotating speed through gears 65 and 66 by the motor 58. The rotary drum 57 has an end wall provided with a plurality of radial grooves 67 arranged at equal angular pitches. The third point needles 43 are fitted in the radial grooves 67 for radial sliding movement and are advanced and retracted by the fixed guide 61 engaged in recesses formed in the third point needles 43, respectively, as the rotary drum 57 rotates. The fixed guide 61 has a semicircular needle projecting section of a set radius corresponding to a range between the third needling position and the transfer position to keep the third point needles 43 projected, and a needle retracting section corresponding to a range between the transfer position and the needling position to retract the projected third point needles 43. The needle raising member 60 is supported pivotally by a pin 71 on a fixed bracket and is driven so as to advance the point needles 43 of the third needle group at the third needling position by drive shaft 68 through a crank pin 69 fixed to the drive shaft 68 and a connecting rod 70 connecting the crank pin 69 to one end of the needle raising member 60. The drive shaft 68 is driven for rotation through gears 72 and 73 by the motor 59. When the rotary drum 57 is rotated and each third point needle 43 is brought to the needling position, the needle raising member 60 advances the third point needle 43 at the needling position to thrust the third point needle 43 into the second knitted fabric 12. The needle raising member 60 may be driven by moving the connecting rod 70 directly up and down by an actuator, such as a solenoid, instead of moving the connecting rod 70 up and down through the gears 72 and 73 and the drive shaft 68 by the motor 59.

Thus, the first point needles 41, the second point needles 42 and the third point needles 43 are arranged along the fabric feed directions in which the first knitted fabric 11 and the second knitted fabric 12 are fed so as to be axially movable along the three intersecting directions, respectively. The first point needles 41, the second point needles 42 and the third point needles 43 thrusted in the first knitted fabric 11 and the second knitted fabric 12, respectively, are movable in the respective fabric feed directions.

Figure 6:
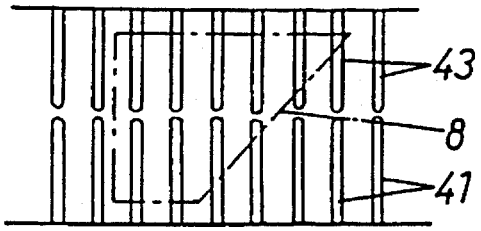
FIG. 6 is a diagrammatic view which assists in explaining the positional relation between first point needles and second point needles, and a second transfer device.
Figure 9:
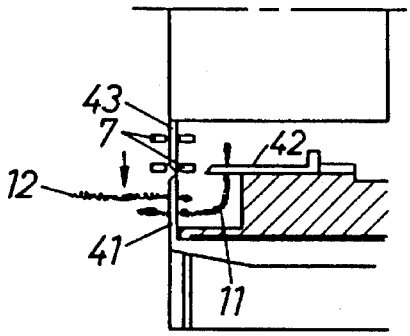
FIG. 9 is a schematic fragmentary sectional view illustrating a state where the second knitted fabric has been transferred from the third point needles to the first point needles.
Figure 10:
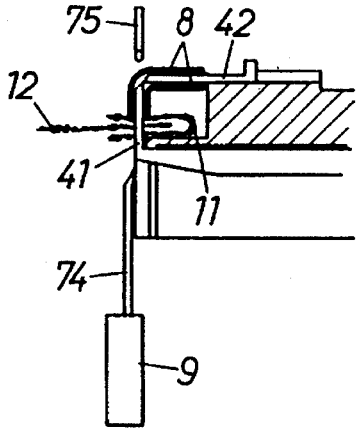
FIG. 10 is a schematic fragmentary sectional view illustrating a state where one edge portion of the first knitted fabric has been transferred from the second point needles to the first point needles by a second transfer device.

Referring to FIGS. 1 and 9, the first transfer device 7 is disposed at a position between the rotary drum 57 and the plate cam 36 and slightly before the linking position to transfer the second knitted fabric 12 hooked over the third point needles 43 to the first point needles 41. The first transfer device 7 comprises a pair of plates disposed on the opposite sides of the third point needles 43 and of the first point needles 41 and extending from a region in which the third point needles 43 move across the transfer position into a region in which the first point needles 41 move. As shown in FIGS. 1, 6 and 10, the second transfer device 8 comprises a pair of L-shaped plate members having L-shaped cross sections, respectively, and disposed behind the first transfer device 7 so as to sandwich the row of the first point needles 41 and the row of the second point needles 42 therebetween. The second transfer device 8 folds the edge portion of the first knitted fabric 11 hooked over the second point needles 42 over the other edge portion of the first knitted fabric 11 hooked over the first point needles 41 and transfers the former edge portion from the second point needles 42 to the first point needles 41 to sandwich the edge portion of the second knitted fabric 12 between the edge portions of the first knitted fabric 11. Each of the pair of L-shaped plate members of the second transfer device 8 has two inclined surfaces inclined at set angles to the longitudinal axes of the first point needles 41 and the second point needles 42, respectively. FIG. 6 is a development of one of the pair of L-shaped plate member of the second transfer device 8. The sewing machine 9 is disposed at the linking position. The sewing machine 9 has a needle 74 and a looper 75 disposed opposite to each other on the opposite sides, respectively, of the edge portions of the first knitted fabric 11 sandwiching the edge portion of the second knitted fabric 12.

Figure 7:
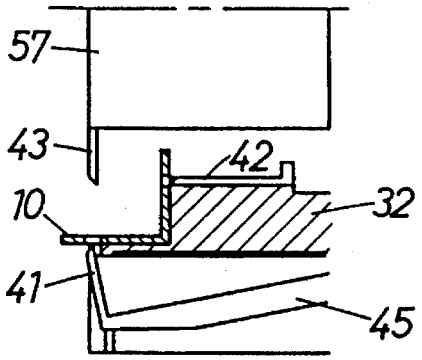
FIG. 7 is a schematic fragmentary sectional view illustrating the positional relation between three point needles opposite to each other.

The sandwich linking operation of the automatic sandwich linking machine 1 will be described as applied to linking a rectangular collar part of a garment as the first knitted fabric 11, and a body part having a neckline of the garment as the second knitted fabric 12. First, the leading ends of the edge portions of the first knitted fabric 11 are hooked over several ones of the first point needles 41 and the second point needles 42 by hand, and the leading end of the edge portion of the second knitted fabric 12 is hooked over several ones of the third point needles 43. The first point needles 41 and the second point needles 42 are not projected from the inner surfaces of the horizontal wall and the vertical wall of the L-shaped table 10, respectively, at positions before the needling position as shown in FIG. 1 and FIG. 7, and the third point needles 43 are not projected from the circumference of the rotary drum 57 before the needling position as shown in FIG. 1. The first fabric guide device 2 guides the two edge portions of the first knitted fabric 11 along a linking line to the first and the second needling position, respectively. The second fabric guide device 3 guides the edge portion of the second knitted fabric 12 to the third needling position. The first fabric guide device 2 and the second fabric guide device 3 perform a stitch finding operation while guiding the first knitted fabric 11 and the second knitted fabric 12. The first and the second needling position are located between the pair of primary hands 17 and between the pair of primary hands 18, respectively, as shown in FIG. 1, and the third needling position is located between the extremities of the pair of secondary hands 27 facing the primary hands 26.

The guiding and stitch finding operations in a horizontal plane of the first fabric guide device 2 will be described in detail. The camera 21 detects the stitches of the first edge portion of the first knitted fabric 11 at a position before the needling position and gives two-dimensional data representing the image of the stitches to the image processing unit 31. The image processing unit 31 determines stitches to be hooked over the first point needles 41 on the basis of the two-dimensional data, and drives the pair of primary hands 17 to move the first edge portion of the first knitted fabric 11 on the horizontal surface of the L-shaped table 10 to position the first edge portion of the first knitted fabric 11 for stitch hooking. The pair of primary hands 17 can be moved toward each other and away from each other and can be moved in directions along the X-, Y- and Z-axis. In the initial stage of the fabric guiding operation, the pair of primary hands 17 clamps both sides of the edge portion to be detected by the camera 21, move away from each other to expand the stitches, move along the Y-axis according to information about the positions of the stitches to be hooked, and then move along the X-axis to guide the stitches to be hooked toward and to position the same at the needling position.

Meanwhile, the pair of secondary hands 19 move away from the first knitted fabric 11 along the Z-axis, and then the pair of secondary hands 19 moves along the X-axis from a position in FIG. 1 to a standby position where the pair of secondary hands 19 will not interfere with the operation of the pair of primary hands 17. After the pair of primary hands 17 separated from each other have positioned the stitches at the needling position, the pair of secondary hands 19 move along the X-axis to positions on the opposite sides of the needling position, respectively, as shown in FIG. 1, and then move along the Z-axis to clamp and hold the first edge portion of the first knitted fabric 11 at the needling position. In this state, the pair of secondary hands 19 are positioned between the pair of primary hands 17 and hence the pair of primary hands 17 and the pair of secondary hands 19 will not interfere with each other. Then, the pair of primary hands 17 are raised to release the first edge portion of the first knitted fabric 11. Then, the first point needles 41 are projected by the needle raising member 35 and thrusted in the first edge portion of the first knitted fabric 11 positioned at the needling position. Then, the pair of primary hands 17 are retracted along the X-axis, moved toward each other and lowered, the pair of secondary hands 19 are raised and moved along the X-axis to the standby position.

The roller 15 moves axially and vertically to guide the first edge portion of the first knitted fabric 11 so that the one of the two edge sensors 13 detects the first edge portion of the first knitted fabric 11 and the other edge sensor 13 does not; that is, so that the first edge portion of the first knitted fabric 11 is located between the two edge sensors 13. The roller 15 can be moved along the Y- and the Z-axis by an actuator, not shown, and rotates to feed the first edge portion of the first knitted fabric 11 along the X-axis in synchronism with the _movement of the hands 17 along the X-axis. The first edge portion of the first knitted fabric 11 is set in a stitch hooking state and is guided to the needling position by the cooperative actions of the pair of edge sensors 13, the roller 15, the pair of primary hands 17, the pair of secondary hands 19, the camera 21 and the image processing unit 31.

The second edge portion of the first knitted fabric 11 is guided, similarly to the first edge portion of the first knitted fabric 11, on the vertical surface of the L-shaped table 10 to position the second edge portion of the first knitted fabric 11 for stitch hooking by the first fabric guide device 2. The pair of secondary hands 27 are supported on a parallel linkage and can be simultaneously moved along both the X-axis and the Z-axis. Accordingly, the first and the second edge portion of the first knitted fabric 11 are moved along the vertical and the horizontal surface of the L-shaped table 10 for stitch finding and needling.

Figure 8:
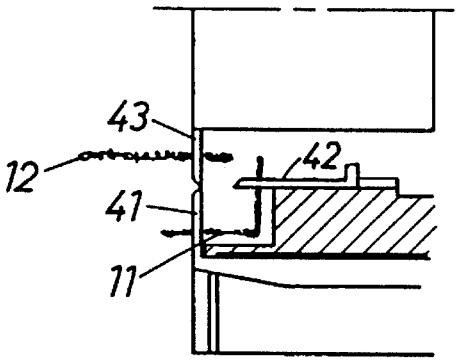
FIG. 8 is a schematic fragmentary sectional view illustrating a state where a first knitted fabric is hooked over the first point needles and the second point needles and a second knitted fabric is hooked over the third point needles.

When the stitches of the first edge portion of the first knitted fabric 11 are found and positioned at the first needling position, the needle raising member 35 raises one of the first point needles 41 to thrust one of the first point needles 41 in the stitches of the first edge portion of the first knitted fabric 11 as shown in FIG. 8. One of the second point needles 42 is projected by the needle projecting member 52 at the second needling position to be thrusted in the second edge portion of the first knitted fabric 11. Thus, the first and the second edge portion of the first knitted fabric 11 are hooked over one of the first point needles 41 and one of the second point needles 42, respectively. The motor 34 moves the slider 33 by a distance corresponding to the pitch of the point needles 41 and 42 toward the linking position in synchronism with the operation for projecting the point needles 41 and 42. These operations are repeated in synchronism with the guiding and stitch finding operation of the first fabric guide device 2 to thrust the first point needles 41 and the second point needles 42 sequentially in the first and the second edge portion of the first knitted fabric 11.

Meanwhile, the presser roller 29 and the guide roller 30 nip the edge portion of the second knitted fabric 12 therebetween and advance the second knitted fabric 12 along the table 23. The second fabric guide device 3 executes operations similar to that of the first fabric guide device 2 to find the stitches of the edge portion of the second knitted fabric 12 and to guide the edge portion of the second knitted fabric to the third needling position. The needle raising member 60 projects one of the third point needles 43 at the third needling position to thrust the third point needles 43 sequentially in the edge portion of the second knitted fabric 12. The rotation of the rotary drum 57 moves the edge portion of the second knitted fabric 12 hooked over the third point needles 43 toward the first transfer device 7. The plurality of third point needles 43 are disposed closely opposite to the first point needles 41, respectively, at the transfer position. As the edge portion of the second knitted fabric 12 moves together with the third point needles 43, the first transfer device 7 moves the edge portion of the second knitted fabric 12 longitudinally of the third point needles 43 and transfers the edge portion of the second knitted fabric 12 from the third point needles 43 to the corresponding first point needles 41 and, consequently, the edge portion of the second knitted fabric 12 is superposed on the first edge portion of the first knitted fabric 11 as shown in FIG. 9.

While the first edge portion of the first knitted fabric 11 and the edge portion of the second knitted fabric held on the first point needles 41 and the second edge portion of the first knitted fabric 11 held on the second point needles 42 are moved toward the linking position, the second transfer device 8 transfers the second edge portion of the first knitted fabric 11 held on the second point needles 42 from the second point needles 42 to the corresponding first point needles as shown in FIG. 10; that is, the needle raising member 53 further projects the second point needles 42 at a position immediately before the transfer position to locate the second point needles 42 close to the corresponding first point needles 41. As the second point needles 42 moves, the second edge portion of the first knitted fabric 11 is released from the second point needles 42 by one of the inclined surfaces of the second transfer device 8 and is hooked over the first point needles 41 by the other inclined surface of the second transfer device 8. Consequently, the edge portion of the second knitted fabric 12 is sandwiched between the first and the second edge portions of the first knitted fabric 11. Then, the sewing machine 9 links the stitches of the first and the second edge portion of the first knitted fabric 11 and the edge portion of the second knitted fabric 12 for sandwich linking.

Either the operation for guiding the edge portions of the first knitted fabric 11 to the first and the second needling position or the operation for guiding the edge portion of the second knitted fabric 12 may be executed only by the edge sensors 13 and 14 and the rollers 15 and 16 or only by the edge sensors 24 and the roller 25 without executing the stitch finding operation including the image processing operation. When the edge portion of the knitted fabric is guided by such a fabric guide device that does not execute the stitch finding operation, the edge portion is needled along a line at a fixed distance from the edge. Stitches that need to be found by the image processing operation are visible ones that appear on the right surface of a finished garment, i.e., stitches to be hooked over the point needles at the first needling position. Therefore, the edge portions of the first knitted fabric 11 and the second knitted fabric 12 to be needled at the second and the third needling position may be guided without finding the stitches by the image processing operation.

Figure 11:
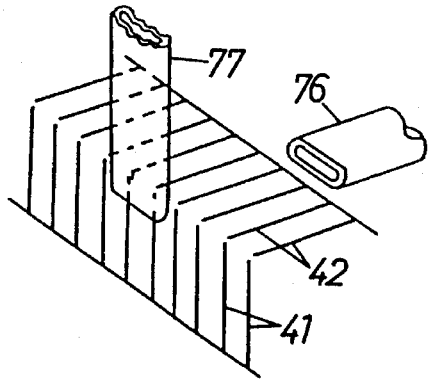
FIG. 11 is a schematic perspective view illustrating transfer nozzles as the functional components of the second transfer device.
Figure 12:
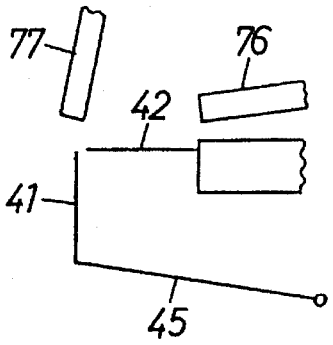
FIG. 12 is a diagrammatic view of transfer nozzles as the components of the second transfer device.

The first transfer device 7 and the second transfer device 8 may comprise air jet nozzles or brushes capable of reciprocating longitudinally of the point needles. Particularly, the second transfer device 8 may comprise two air jet nozzles 76 and 77 as shown in FIGS. 11 and 12. The air jet nozzles 76 and 77 are controlled so that the air jet nozzle 77 jets air after the air jet nozzle 76 has jetted air. The second transfer device 8 may comprise two brushes, not shown, capable of reciprocating longitudinally of the first point needles 41 and the second point needles 42, respectively. The brushes are controlled so that the brush associated with the first point needles 41 move toward the base ends of the first point needles 41 after the brush associated with the second point needles 42 has moved toward the tips of the second point needles.

One photoelectric sensor and a signal generating means for generating a signal representing the ratio of an area held by the edge portion of the knitted fabric in the sensing area of the photoelectric sensor to the sensing area may be employed instead of each of the pairs of edge sensors 13, 14 and 24, and the rollers 15 and 16 or the roller 25 may be controlled so that the ratio of an area held by the edge portion of the knitted fabric to the sensing area remains constant.

Second Embodiment

Figure 13:
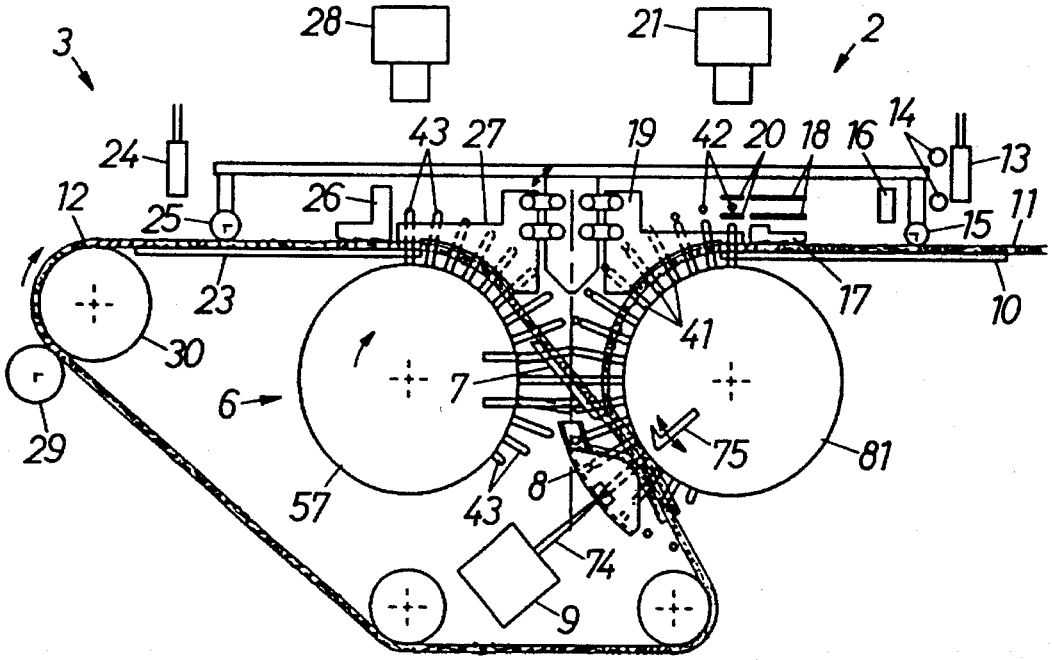
FIG. 13 is a schematic side view of an automatic sandwich linking machine in a second embodiment according to the present invention.
Figure 14:
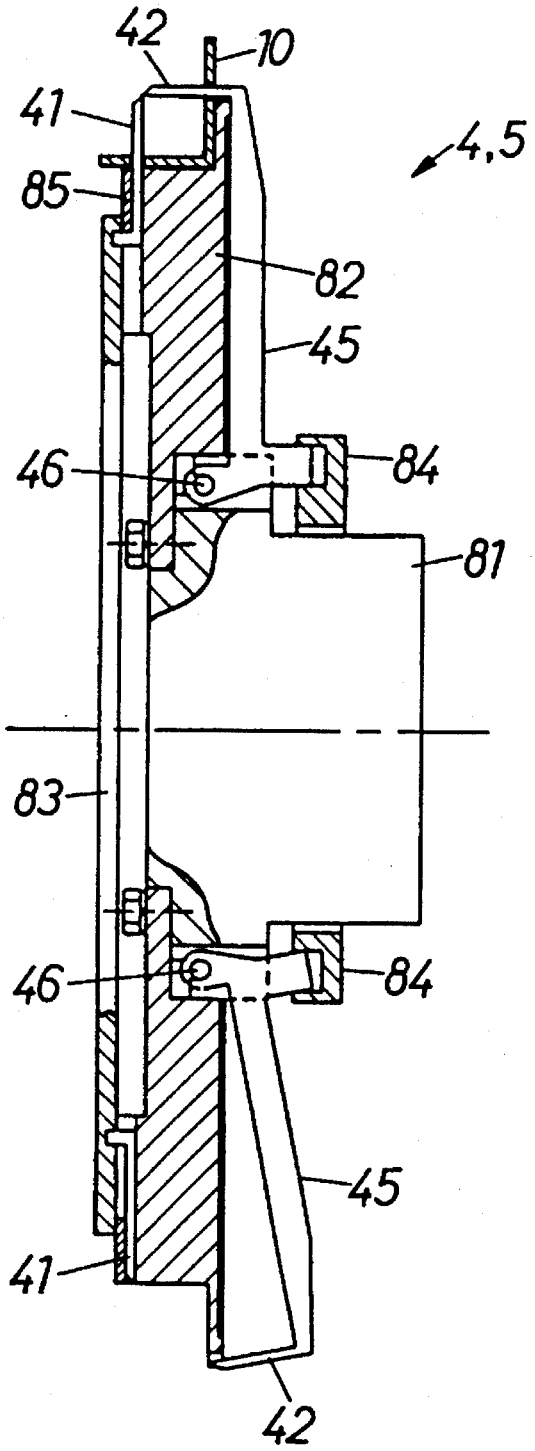
FIG. 14 is a fragmentary sectional view of the automatic sandwich linking machine of FIG. 13.
Figure 15:
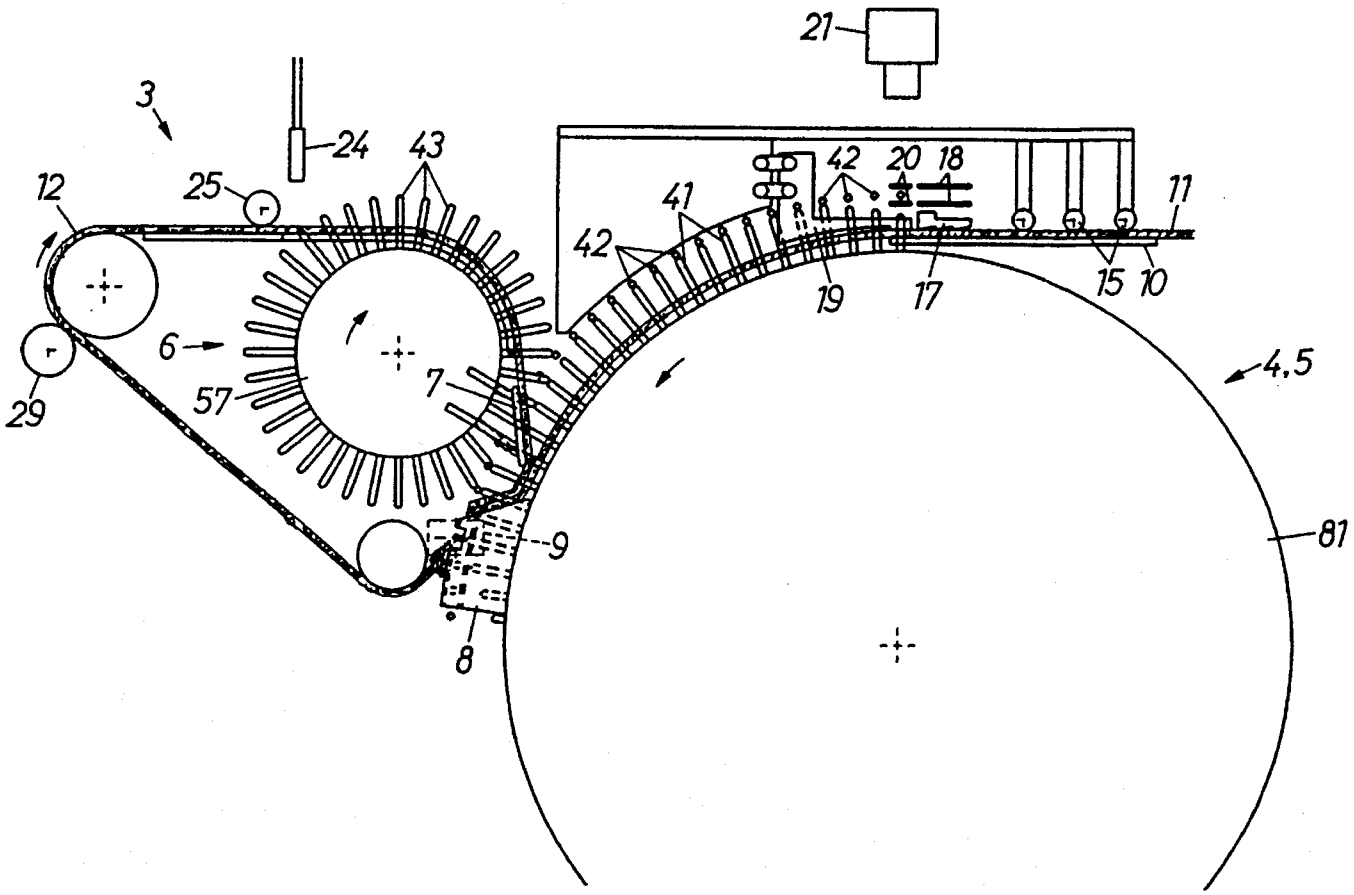
FIG. 15 is a schematic side view of an automatic sandwich linking machine in a third embodiment according to the present invention.
Figure 16:
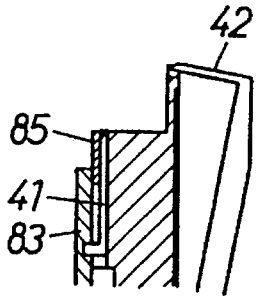
FIG. 16 is a schematic fragmentary sectional view which assists in explaining the positional relation between the first point needles and the second point needles.
Figure 17:
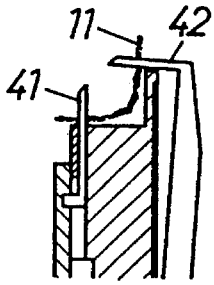
FIG. 17 is a schematic fragmentary sectional view illustrating a state where the first knitted fabric is hooked over the first and the second point needles.
Figure 18:
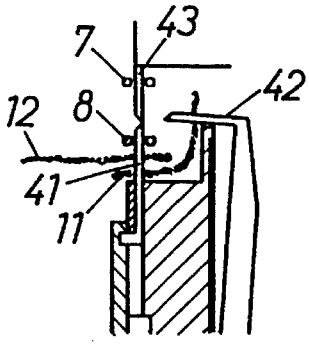
FIG. 18 is a schematic fragmentary sectional view illustrating a state where the second knitted fabric has been transferred from the third point needles to the first point needles.
Figure 19:
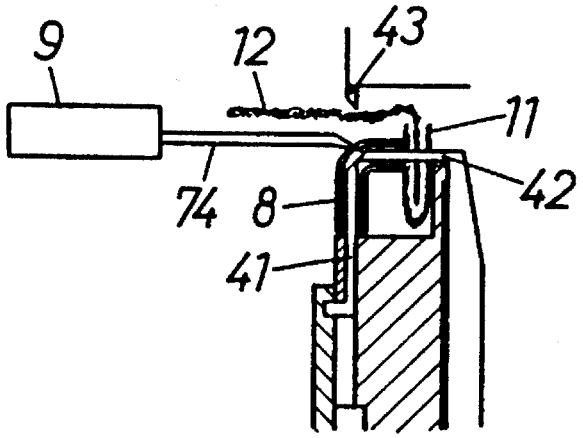
FIG. 19 is a schematic fragmentary sectional view illustrating a state where one of the edge portions of the first knitted fabric and the edge portion of the second knitted fabric have been transferred from the first point needles to the second point needles by the second transfer device.
Figure 20:
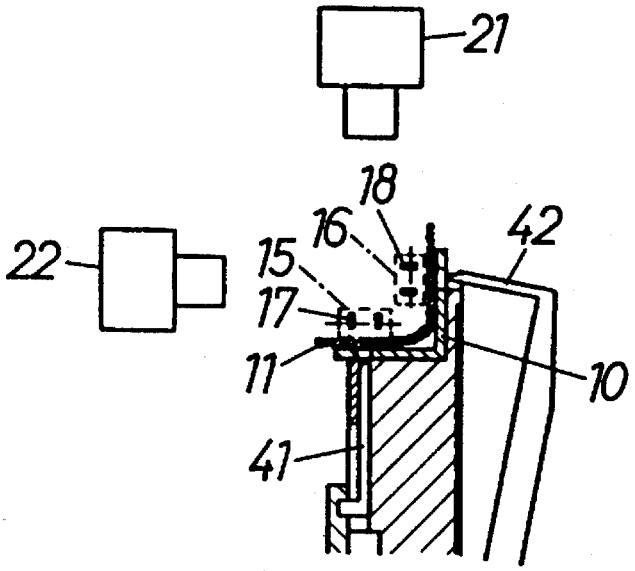
FIG. 20 is a side view of a first fabric guiding device.

Referring to FIGS. 13 and 14 showing an automatic sandwich linking machine in a second embodiment according to the present invention, the first and the second edge portion of a first knitted fabric 11 are hooked over first point needles 41 and second point needles 42 radially extended on a rotary drum 81, respectively. The first point needles are slidably fitted in radial grooves formed in the front surface of a projecting member 82 and are advanced and retracted radially by a fixed disk-shaped groove cam 83. The second point needles 42 are advanced and retracted by the cooperative actions of levers 45 and a fixed groove cam 84. The groove cam 84 is formed so as to advance the second point needles 42 in two steps; the second point needles 42 are advanced to hook the second edge portion of a first knitted fabric 11 at a needling position and then advanced further at a transfer position so that the tips of the second point needles 42 are located close to the tips of the corresponding first point needles 41 after the edge portion of a second knitted fabric 12 has been transferred from third point needles 43 to the first point needles. The first point needles 41 are held in the radial grooves by a holding member 85.

The automatic sandwich linking machine in the second embodiment has a first fabric guide device 2, a second fabric guide device 3, a first transfer device 7 and a second transfer device 8 similar to those of the first embodiment. The function and constitution of a pair of secondary hands 19 are the same as those of the pair of secondary hands 27. A sewing machine 9 is disposed at a position where the first knitted fabric 11 and the second knitted fabric 12 are combined to link the knitted fabrics 11 and 12 together.

Modifications similar to those possible in the first embodiment may be made in the second embodiment.

Third Embodiment

Referring to FIGS. 15 to 20, an automatic sandwich linking machine in a third embodiment according to the present invention, similarly to the second embodiment, hooks the respective edge portions of a first knitted fabric 11 and a second knitted fabric 12 over first point needles 41 in a circular arrangement, second point needles 42 in a circular arrangement and third point needles 43 in a circular arrangement, respectively, transfers the edge portion of the second knitted fabric 12 from the third point needles 43 to the first point needles 41, and then transfers the first edge portion of the first knitted fabric 11 and the edge portion of the second knitted fabric 12 from the first point needles 41 to the second point needles 42. A second fabric guide device 3 comprises a pair of edge sensors 24 and a roller 25. The rest of the components of the third embodiment are substantially the same as those of the second embodiment.

Although the invention has been described in its preferred embodiments with a certain degree of particularity, obviously many changes and variations are possible therein. It is therefore to be understood that the present invention may be practiced otherwise than as specifically described herein without departing from the scope and spirit thereof.

What is claimed is:

1. A sandwich linking method, which folds a first knitted fabric in two to sandwich an edge portion of a second knitted fabric between a first and a second edge portion of the first knitted fabric for linking, and uses first point needles, second point needles and third point needles arranged along a linking line, held so as to be advanced and retracted and controlled so that the tips of the first and the third point needles are disposed opposite to each other at a first transfer position and the tips of the first and the second point needles are disposed opposite to each other at a second transfer position, said sandwich linking method comprising: guiding a first and a second edge portion of the first knitted fabric to a first and a second needling position, respectively; hooking the first and the second edge portion of the first knitted fabric over the first and the second point needles, respectively; guiding an edge portion of the second knitted fabric to a third needling position; hooking the edge portion of the second knitted fabric over the third point needles; transferring the edge portion of the second knitted fabric from the third point needles to the first point needles; transferring the first edge portion of the first knitted fabric and the edge portion of the second knitted fabric from the first point needles to the second point needles or transferring the second edge portion of the first knitted fabric from the second point needles to the first point needles to sandwich the edge portion of the second knitted fabric between the first and the second edge portion of the first knitted fabric; and linking the superposed edge portions of the first and the second knitted fabric together by a sewing machine.

2. An automatic sandwich linking machine, which sandwiches an edge portion of a second knitted fabric between a first and a second edge portion of a first knitted fabric and links together the superposed edge portions of the first and the second knitted fabric; said sandwich linking machine comprising:

a plurality of first point needles arranged at intervals so as to be axially advanced and retracted;

a plurality of third point needles arranged at intervals so as to be axially advanced and retracted, and to be able to be positioned with their tips closely opposite to the tips of the first point needles, respectively;

a first fabric guiding means for guiding the first edge portion of the first knitted fabric to a first needling position;

a first needle moving means for thrusting the first point needles in the first edge portion of the first knitted fabric at the first needling position and moving the first edge portion of the first knitted fabric together with the first point needles;

a second fabric guiding means for guiding the edge portion of the second knitted fabric to a third needling position;

a third needle moving means for thrusting the third point needles in the edge portion of the second knitted fabric at the third needling position, and moving the edge portion of the second knitted fabric together with the third point needles;

a first transfer means for transferring the edge portion of the second knitted fabric from the third point needles to the first point needles; and a sewing machine (9) for linking the superposed edge portions of the first and the second knitted fabric together;

characterized by:

a plurality of second point needles arranged at intervals so as to be axially advanced and retracted and to be able to be positioned with their tips closely opposite to the tips of the first point needles, respectively;

a second needle moving means for thrusting the second point needles in a second edge portion of the first knitted fabric at a second needling position and moving the second edge portion of the first knitted fabric together with the second point needles in the same direction as that in which the first point needles are moved; and a second transfer means for transferring the first edge portion of the first knitted fabric and the edge portion of the second knitted fabric from the first point needles to the second point needles or transferring the second edge portion of the first knitted fabric from the second point needles to the first point needles to sandwich the edge portion of the second knitted fabric between the first and the second edge portion of the first knitted fabric.

3. An automatic sandwich linking machine according to claim 2, wherein the first needle moving means and the second needle moving means include in common a slider capable of linearly moving along a linking line, the first point needles are arranged in connection with one of the two guide surfaces of a table for guiding the first knitted fabric, the second point needles are arranged in connection with the other guide surface of the table, and the first and the second point needles are advanced and retracted by fixed cams, respectively.

4. An automatic sandwich linking machine according to claim 2, wherein the first needle moving means and the second needle moving means are incorporated into a rotary drum, the first point needles are arranged in connection with one of the two guide surfaces of a table, the second point needles are arranged in connection with the other guide surface of the table, and the first and the second point needles are advanced and retracted by fixed cams, respectively.

5. An automatic sandwich linking machine according to claim 2, wherein the second transfer means includes a transfer plate.

6. An automatic sandwich linking machine according to claim 2, wherein the second transfer means includes a plurality of air jet nozzles.

* * * * *